US006782800B2

(12) United States Patent
Strain

(10) Patent No.: US 6,782,800 B2
(45) Date of Patent: Aug. 31, 2004

(54) DIAMOND-SHAPED FLUID POWERED LINKAGE, SYSTEM AND ENGINE

(76) Inventor: David Strain, 35 O'Brien Avenue, Stouffville, ON (CA), L4A 1G6

( * ) Notice: Subject to any disclaimer, the term of this patent is extended or adjusted under 35 U.S.C. 154(b) by 6 days.

(21) Appl. No.: 10/130,272

(22) PCT Filed: Dec. 20, 2000

(86) PCT No.: PCT/CA00/01567

§ 371 (c)(1),
(2), (4) Date: May 28, 2002

(87) PCT Pub. No.: WO01/46594

PCT Pub. Date: Jun. 28, 2001

(65) Prior Publication Data

US 2002/0178719 A1 Dec. 5, 2002

Related U.S. Application Data

(60) Provisional application No. 60/172,998, filed on Dec. 21, 1999.

(51) Int. Cl.[7] ..... F01B 19/02
(52) U.S. Cl. ..... 92/36; 92/89
(58) Field of Search ..... 92/34, 36, 89

(56) References Cited

U.S. PATENT DOCUMENTS

| | | | | | |
|---|---|---|---|---|---|
| 147,519 | A | * | 2/1874 | Reilley | 92/89 |
| 345,446 | A | * | 7/1886 | Powers | 92/89 |
| 696,768 | A | * | 4/1902 | Sleeper | 92/89 |
| 2,618,930 | A | | 11/1952 | Quinn | |
| 3,987,767 | A | * | 10/1976 | Buske | 92/89 |
| 4,027,480 | A | | 6/1977 | Rhodes | |
| 4,044,654 | A | | 8/1977 | Guillon | |
| 4,256,018 | A | | 3/1981 | Badoureaux et al. | |
| 4,651,690 | A | * | 3/1987 | Yang | 92/75 |
| 5,081,840 | A | | 1/1992 | Landon | |
| 5,145,338 | A | * | 9/1992 | Murray | 92/92 |
| 5,865,028 | A | | 2/1999 | Klauk et al. | |

FOREIGN PATENT DOCUMENTS

DE 1 523 671 A 1/1970

* cited by examiner

*Primary Examiner*—F. Daniel Lopez
(74) *Attorney, Agent, or Firm*—Bereskin & Parr

(57) ABSTRACT

A fluid powered linkage (12) has at least three side plates (18) of substantially equal width joined by connectors (17) to form a polygon of variable cross sectional area. An upper plate and a lower plate enclose a variable volume within the polygon. At least one port (37) allows fluid to enter into or leave from the enclosed variable volume in a controllable manner. Seals prevent fluid from entering or leaving the enclosed variable volume other than through the one or more ports. Two abutments (19, 11) are located on the side plates or connectors and the distance between the two abutments varies non-linearly with, but in the same direction as, the variable cross-sectional area. Optionally, an inner surface of one or more of the side plates defines a recess. A preferred linkage has a cross-section in the shape of a diamond or rhombus of varying internal angles, or a half or quarter thereof. In use, the obtuse angle preferably ranges from nearly 180 degrees to about 135 degrees. The linkage is used in an apparatus for producing a fluid output with altered pressure, volume or flow compared to a fluid input and a hydraulic motor.

13 Claims, 12 Drawing Sheets

DIAMOND-SHAPED FLUID POWERED LINKAGE, SYSTEM AND ENGINE

FIELD OF THE INVENTION

This invention relates to fluid powered systems and in particular to fluid powered linkages and engines.

BACKGROUND OF THE INVENTION

In many hydraulic or pneumatic systems, a master cylinder or pump is fluidly connected to a slave cylinder to transmit force or work to a remote location. When master and slave cylinders of unequal diameters are used, the force applied by the slave cylinder may be more or less than the force applied to the master cylinder. Similarly, the displacement of the slave cylinder may be more or less than the displacement of the master cylinder. In these systems, however, there is always a linear relationship between the force or displacement of the slave cylinder and the force or displacement of the master cylinder. Similarly, when a pump is used to drive a slave cylinder, the force exerted by the slave cylinder is always linearly related to the pressure produced by the pump. To achieve any other relationship requires additional mechanical linkages at one end. Similarly, the design of hydraulic or pneumatic engines using cylindrical linkages is limited by such linear relationships.

SUMMARY OF THE INVENTION

An object of the present invention is to provide a fluid powered, preferably hydraulic, linkage with non-linear relationships between (a) the flow, volume or pressure of fluid added to the linkage and (b) the displacement of the linkage or the force applied by the linkage. Another object is to provide an apparatus for producing a fluid output with altered pressure, volume or flow compared to a fluid input. Yet another object of the present invention is to provide an engine using a linkage as mentioned above. These objects are met by the combination of features, steps or both found in the independent claims, the dependent claims disclosing further advantageous embodiments of the invention. The following summary may not describe all necessary features of the invention which may reside in a sub-combination of the following features or in a combination with features described in other parts of this document.

In one aspect, the invention provides a fluid powered linkage having at least three sides of substantially equal width joined by connectors to form a polygon of variable cross sectional area. Side plates enclose a variable volume within the polygon. At least one port allows fluid to enter into or leave from the enclosed variable volume in a controllable manner. Seals prevent fluid from entering or leaving the enclosed variable volume other than through the one or more ports. Two abutments are located on the sides or connectors and the distance between the two abutments varies non-linearly with, but in the same direction as, the variable cross-sectional area. Optionally, an inner surface of one or more of the sides defines a recess.

Preferred linkages have a cross-section in the shape of a diamond or rhombus of varying internal angles, or a half or quarter thereof. Where the cross-section is a diamond, four sides are connected by hinges. The four sides are of about equal length and the abutments are located substantially at the obtuse angles of the diamond. In use, the obtuse angle preferably ranges from nearly 180 degrees to about 135 degrees. A preferred seal is made of a resilient membrane forming a plenum which varies in volume as the membrane expands or contracts. The membrane is placed with the variable volume enclosed by the linkage and a port connects the interior of the plenum with the outside of the linkage.

In another aspect, the invention relates to an apparatus for producing a fluid output with altered pressure, volume or flow compared to a fluid input. The apparatus comprises a linkage as described above and a piston movable in a cylinder to vary an enclosed volume in the cylinder. A cylinder port allows fluid to exit or enter the enclosed volume of the cylinder. A rod between one of the two abutments of the linkage and the piston ties the movement of one to the other. One or more spacing members to hold the other of the two abutments of the linkage at a constant spacing from the cylinder. Preferably, the area of the piston is equal to or slightly more than the area of each of a side of a diamond-shaped linkage and less than twice the area of a side of the diamond-shaped linkage.

In yet another aspect, the invention relates to a fluid powered motor comprising the apparatus described above.

BRIEF DESCRIPTION OF THE DRAWINGS

Preferred embodiments of the present invention will now be described with reference to the following figures.

DETAILED DESCRIPTION OF EMBODIMENTS

Figure 1:
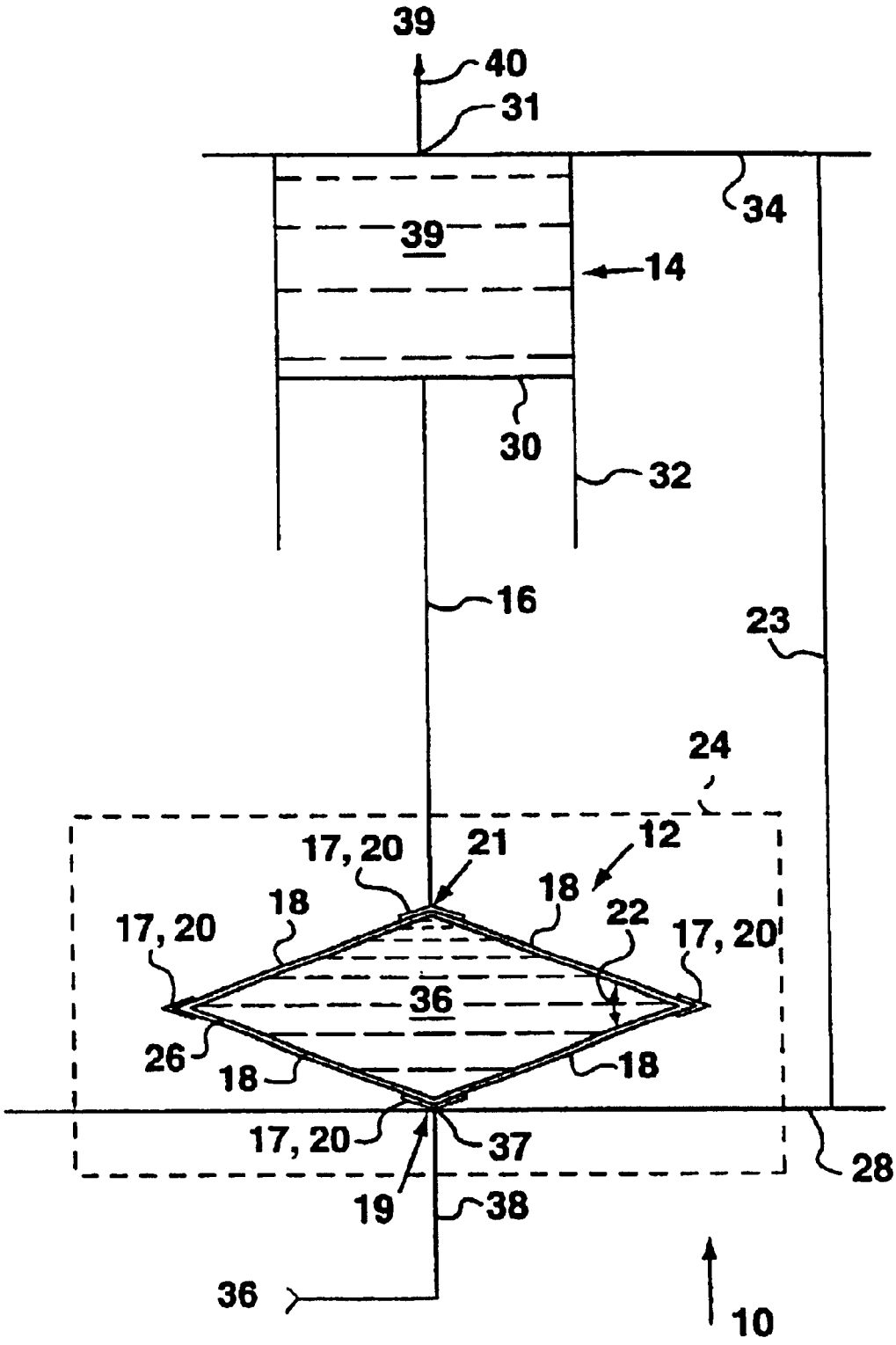
FIG. 1 is a schematic front-view representation of a system having a diamond-shaped linkage.
Figure 2:
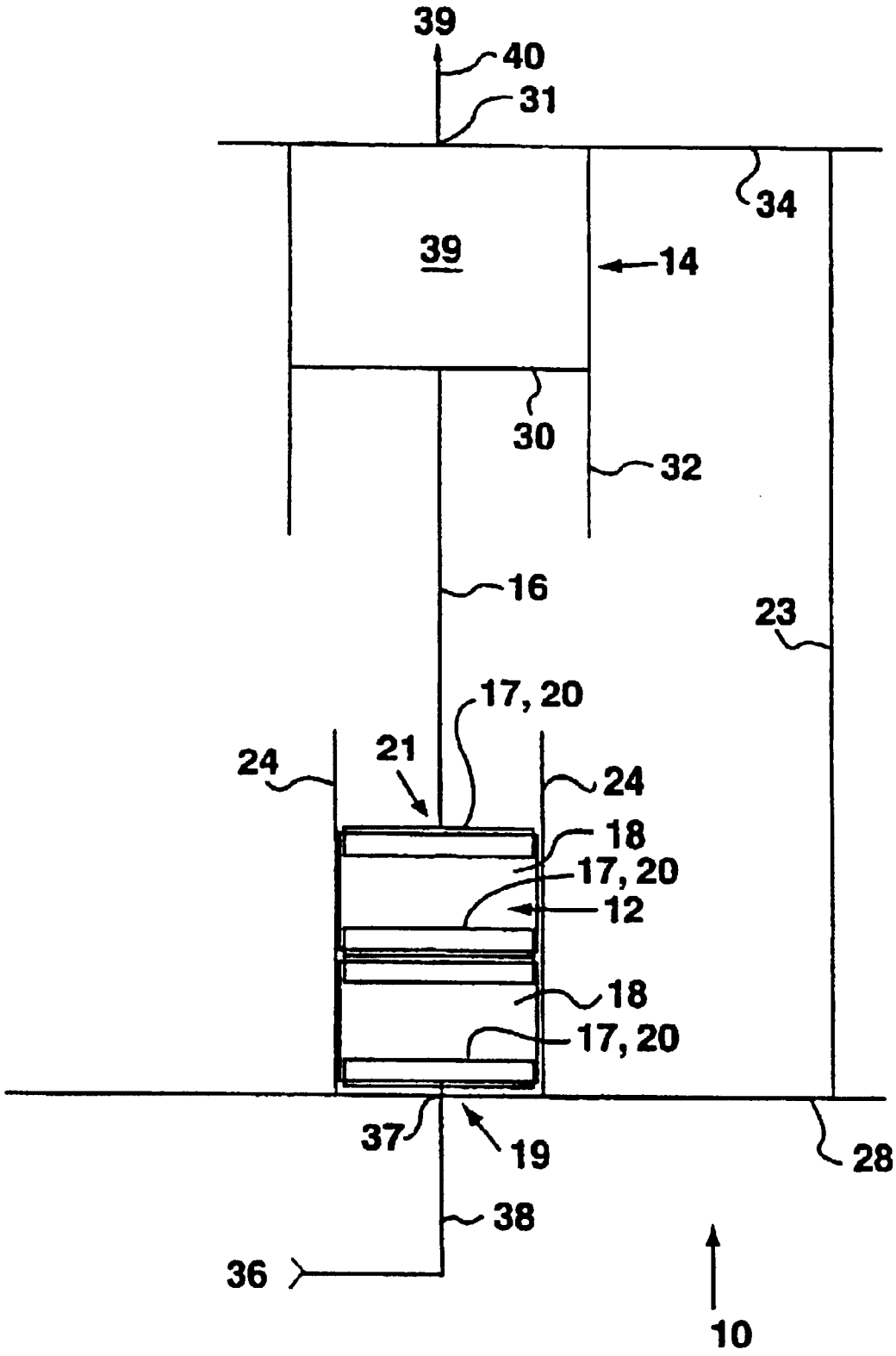
FIG. 2 is a schematic side-view representation of the system of FIG. 1.

Referring now to FIGS. 1 and 2, a fluid powered system 10 has a diamond-shaped linkage 12 and a cylindrical linkage 14 connected by a solid rod 16. The diamond-shaped linkage 12 has four sides 18, preferably of about equal length and area, connected by connectors 17, which are preferably hinges 20, such that a side angle 22 can vary from nearly 0 degrees to 90 degrees. Preferably, however, the side angle 22 does not exceed about 45 degrees, the diamond-shaped linkage being apparently less efficient as the side angle 22 increases beyond the point where the obtuse angles of the diamond-shaped actuator are less than about 135 degrees. Side plates 24 enclose a variable volume inside of the four sides 18 of the diamond-shaped linkage 12 but do not prevent movement of the sides 18 parallel to side plates 24. The volume contained in the diamond-shaped linkage 12 is surrounded and sealed by a membrane 26 located inside of the diamond-shaped linkage 12. The membrane 26 is made of resilient material such as rubber which forms a plenum which varies in volume as the membrane expands or contracts. The membrane 26 is pre-stretched and lubricated with liquid silicone so that it requires little force to expand it once inside of the diamond-shaped linkage 12. A thicker piece of rubber is preferably placed between the hinges 20 and the membrane 26 to reduce abrasion of the membrane 26. Alternately, a system of hydraulic seals could be used to replace the membrane 26 such that the sides 18 and side plates 24 form a plenum directly.

One of the hinges 20 or a part of one side 18 which is very close to one of the hinges provides a lower abutment 19 located substantially at an obtuse angle of the diamond-shaped linkage 12. The lower abutment 19 and the side plates 24 are attached to a base plate 28 which allows the diamond-shaped linkage 12 to be attached to a machine etc.

The cylindrical linkage 14 has a piston 30 sealed but slidable within a cylinder 32 attached to a mounting plate 34. As the piston 30 moves within the cylinder 32 it varies a volume enclosed in the cylinder 32. A cylinder port 31 allows fluid 39 to exit or enter the enclosed volume of the cylinder 32.

The rod 16 connects the piston 30 to the diamond-shaped actuator at an upper abutment 21 located substantially at an obtuse angle of the diamond-shaped linkage 12. One or more spacing members 23 hold the mounting plate 34 at a constant spacing from the base plate 28 and thus hold the lower abutment 19 at a constant spacing from the cylinder 32. Despite the use of the terms lower abutment 19 and upper abutment 21, the diamond-shaped linkage 12 may also be placed in other orientations such as horizontally with the lower abutment 19 and upper abutment 21 spaced horizontally rather than vertically from each other. Similarly, the cylindrical linkage 14 and other components may be oriented in various ways.

The base plate 28 and mounting plate 34 are fixed relative to each other. A fluid 36 flows through an inlet pipe 38 sealed in communication with the membrane 26 in the diamond-shaped linkage 12 through a port 37 such that fluid 36 can leave or enter the plenum of the membrane 26 enclosing the variable volume of the diamond-shaped linkage 12. The membrane 26 provides a seal around the variable volume of the diamond-shaped linkage 12 which prevents fluid 36 from entering or leaving the variable volume of the diamond-shaped linkage other than through the port 37. As fluid 36 enters the diamond-shaped linkage 12 it forces it open, increasing the side angle 22 and the distance between the lower abutment 19 and the upper abutment 21 which pushes the rod 16 away from the base plate 28. The rod 16 in turn pushes the piston 30 driving driven fluid 39 out of the cylindrical linkage 14 through an outlet pipe 40.

In the fluid powered system 10, the cylindrical linkage 14 serves to convert the movement of the rod 16 from mechanical force to a pressurised volume of driven fluid 39. By choosing a larger or smaller diameter cylindrical linkage 14, the pressure or displacement of driven fluid 39 in the outlet pipe 40 may also be modified as in a conventional master-slave hydraulic or pneumatic system. These conversions, however, are linear in nature. It is the action of the rod 16 compared to the flow of fluid 36 into the diamond-shaped linkage 12 that is primarily of interest.

Figure 3:
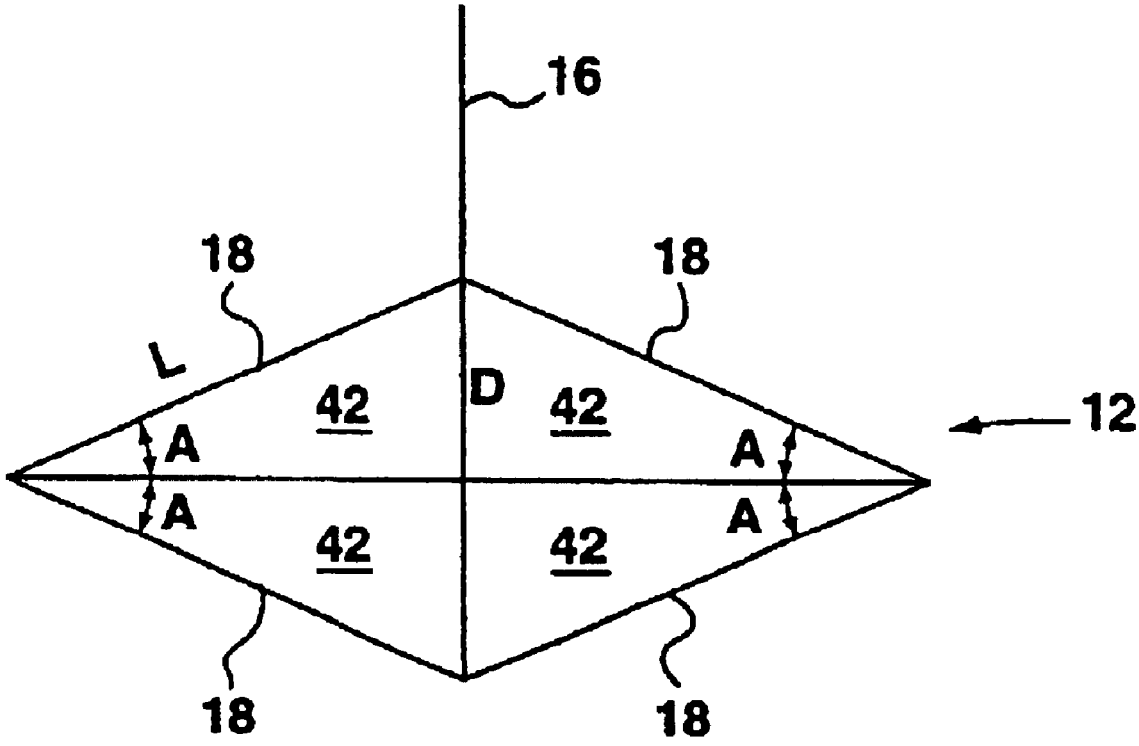
FIG. 3 is a schematic side-view representation of a diamond-shaped linkage.

One characteristic of concern is the relationship between the displacement of the rod 16 and the volume of fluid 36 entering the diamond-shaped linkage 12 which is equal to the change in volume within the diamond-shaped linkage 12. Referring now to FIG. 3, a diamond shaped linkage 12 is divided into four quadrants 42. The sides 18 of the diamond shaped linkage 12 have length L and width W, width W extending out of the page in FIG. 3. Each quadrant 42 has an angle A, a displacement D and a volume V. Accordingly, $$D=2\cdot L\cdot \sin A;\ \text{and,} \tag{1}$$

$$V=2\cdot W\cdot L\ \sin A\cdot L\ \cos A. \tag{2}$$

Figure 4:
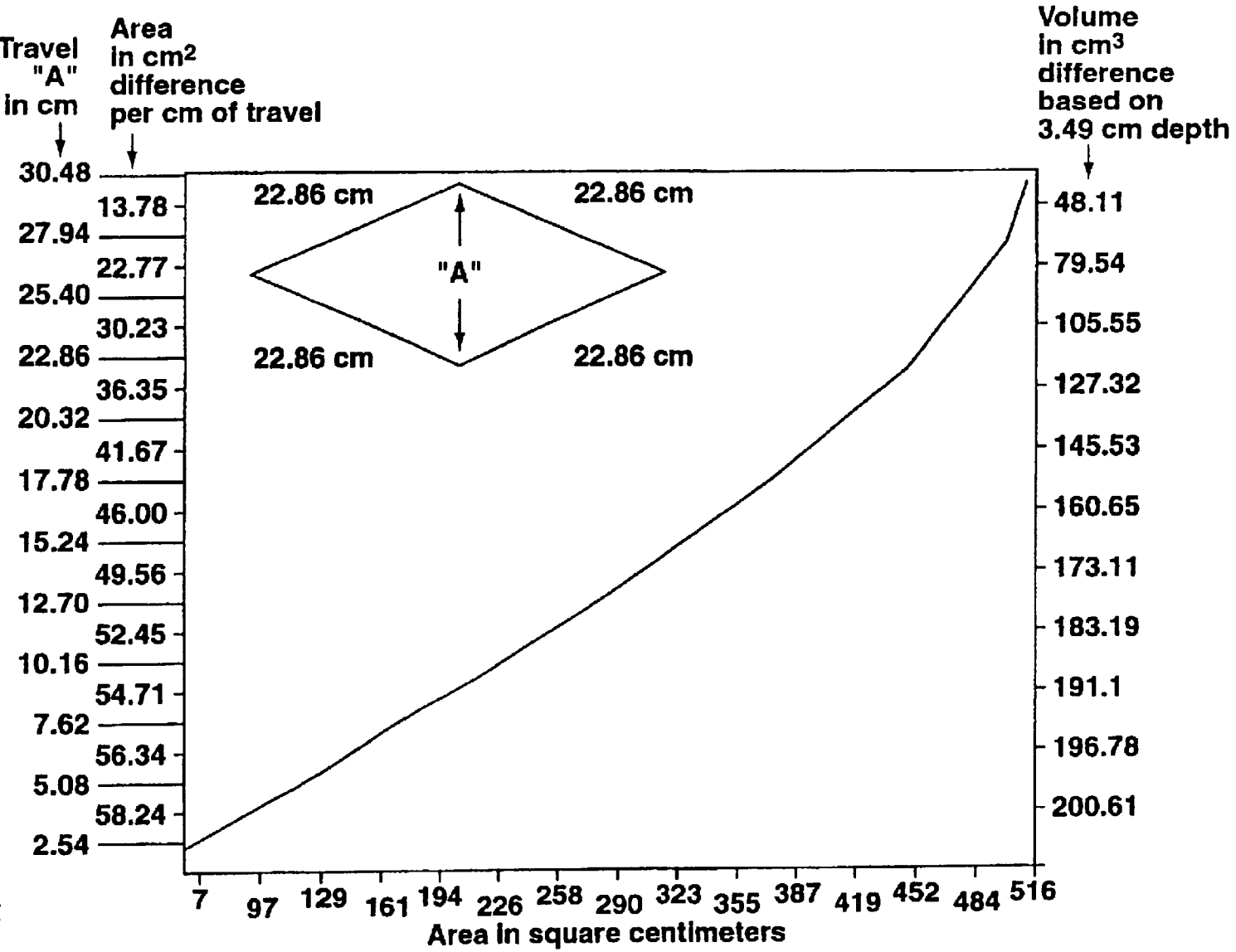
FIG. 4 is a chart comparing displacement and volume for a diamond-shaped linkage.

By selecting different values of A between 0 and 45 degrees, a chart comparing volume and displacement of the diamond shaped linkage 12 can be drawn. Such a chart is shown in FIG. 4 for a diamond-shaped linkage 12 of the size indicated. At very small volumes V, increases in D are nearly proportional to increases in V. At larger volumes, however, D increases faster than V.

Referring to FIGS. 1 and 2, the combination of a diamond shaped linkage 12 with a cylindrical linkage 14 creates an apparatus for producing a fluid output with altered pressure, volume or flow characteristics compared to a fluid input. In such an apparatus, it is preferred if the volume displaced by the cylindrical linkage for a selected movement of the rod 16 is greater than the volume added to the diamond shaped linkage 12 to produce the selected movement of the rod 16. This occurs over the entire range of movement of the diamond shaped linkage 12 if the area of the piston 30 is at least equal to the area of a side 18. For example, a diamond shaped linkage 12 having four equal sides 18 each 1" by 10" in size is connected by a rod 16 to a cylindrical linkage 14 having a piston 30 of 10 square inches in area. To displace 10 cubic inches of fluid in the cylindrical linkage requires the rod to move 1" which can be achieved by filling the diamond shaped linkage 12 with just under 10 cubic inches of fluid of the appropriate pressure. To displace 70 cubic inches of fluid in the cylindrical linkage requires the rod to move 7" which can be achieved by filling the diamond shaped linkage 12 with about 65 cubic inches of fluid of the appropriate pressure. To displace 140 cubic inches of fluid in the cylindrical linkage requires the rod to move 14" which can be achieved by filling the diamond shaped linkage 12 with about 100 cubic inches of fluid of the appropriate pressure. The area of the piston 30 is preferably less than twice the area of a side 18 and more preferably between 1.0 and 1.1 times the area of a side 18.

Figure 5A:
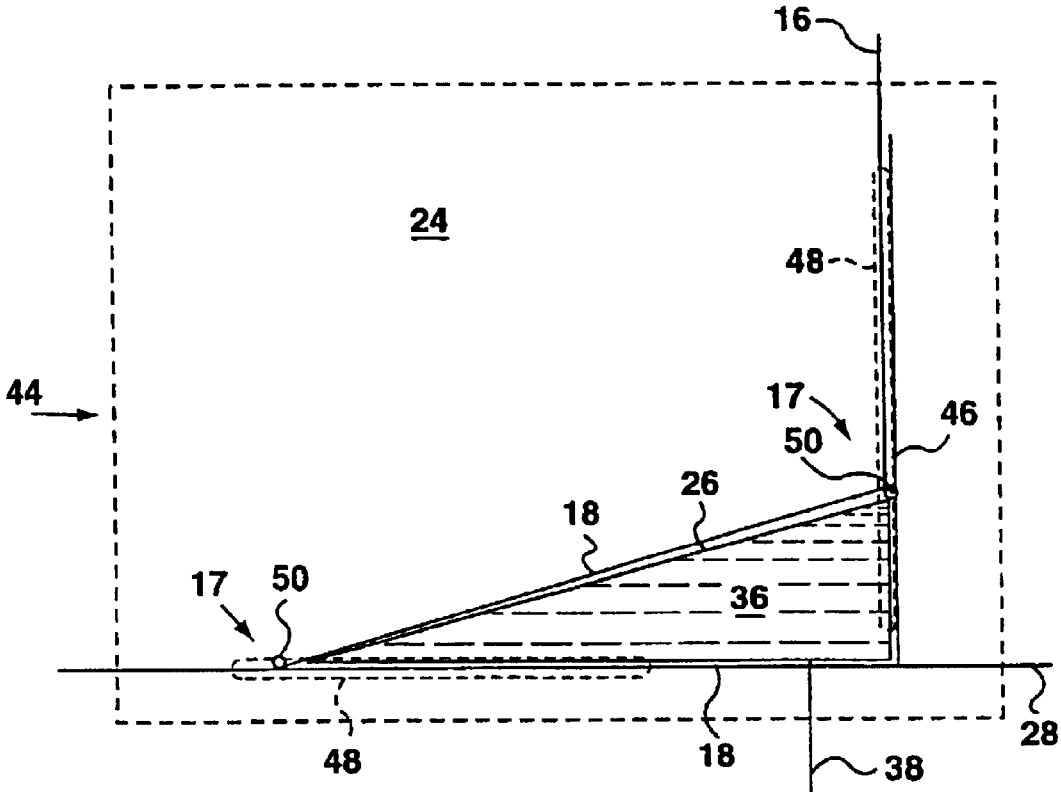
FIG. 5A shows a right angled triangle linkage.
Figure 6A:
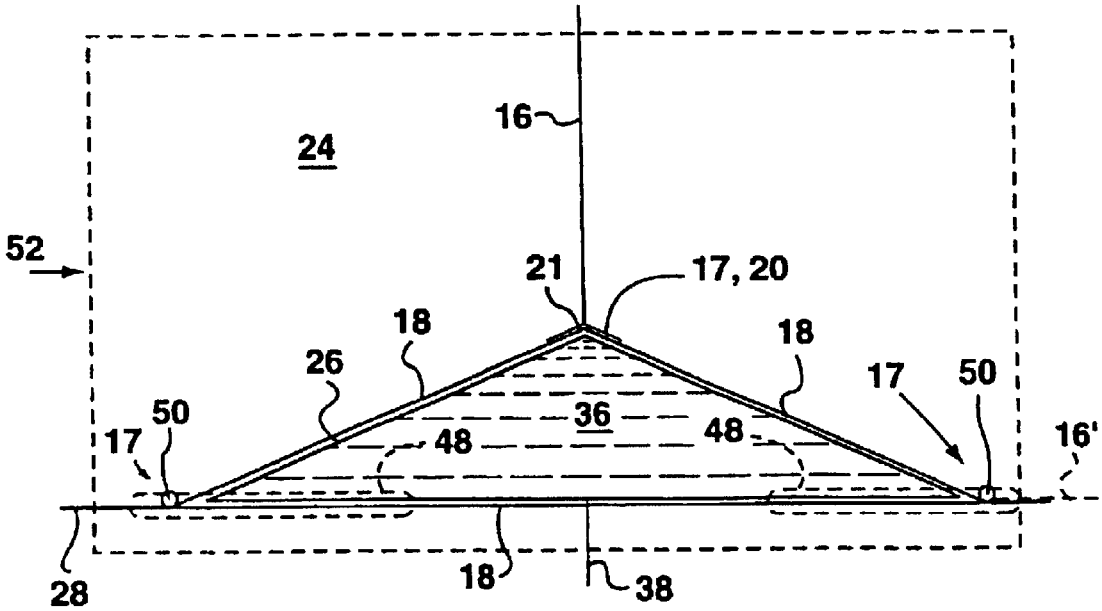
FIG. 6A shows an isosceles triangle linkage for which the base of the triangle has variable length.

Linkages in the shape of one or two quadrants 42 of the diamond shaped linkage 12 can also be constructed and will have similar characteristics. These linkages use three sides 18 (although the sides 18 may also be given other names) and at least two connectors 17 which provide a sliding connection. In FIG. 5A, a right angled linkage 44 has a single side 18 and an end plate 46. Grooves 48 in the side plates 24 accept pins 50 attached to the ends of the side 18 and allow the side 18 to move as would a single quadrant 42 of the diamond-shaped actuator 12. In FIG. 6A, an isosceles triangle linkage 52 has two sides 18 having pins 50 on their distal ends. The isosceles triangle linkage 52 has the characteristics of two quadrants 42 of the diamond-shaped actuator 12 and can be used with a rod 16 as shown with a solid line or with a rod 16' as shown with a dashed line.

Figure 5B:
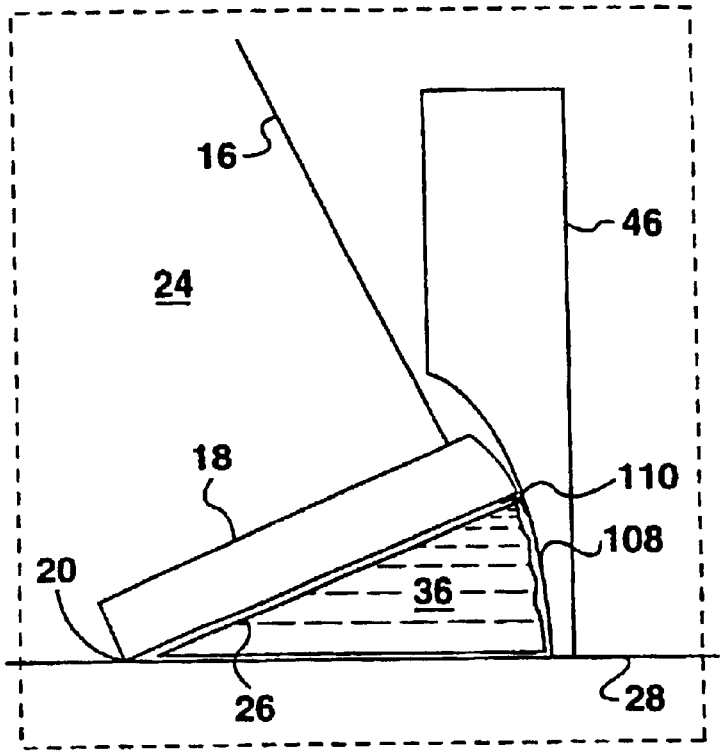
FIG. 5B shows a linkage in the shape of a segment of a cylinder.
Figure 6B:
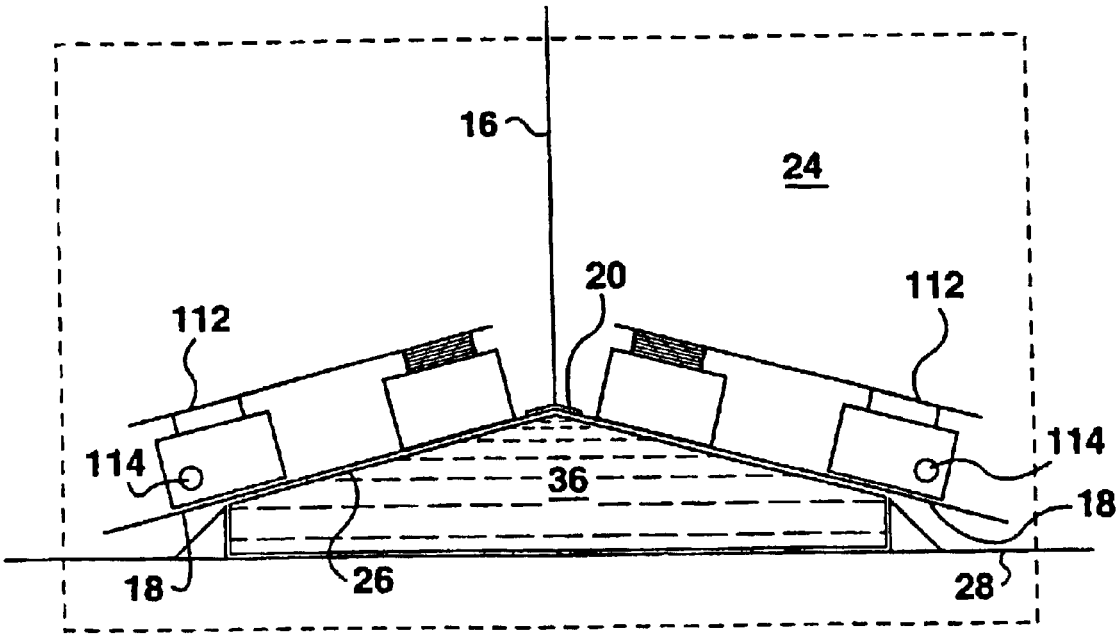
FIG. 6B shows an isosceles triangle linkage for which the sides of the triangle have variable length.

FIGS. 5B and 6B show related linkages. In FIG. 5B, a first end of a side 18 pivots on a hinge 20 while a second end of the side 18 rotates through an arc creating a linkage with the shape of a segment of a cylinder. A curve 108 in the end plate 46 and a seal 110 restrain the membrane 26 in the proper shape. This linkage is similar to the linkage in FIG. 5A but with a different relationship of pressure, volume and force produced by the rod 16. The linkage of FIG. 5A may be more efficient because it has no internal forces acting on the second end of the side 18. In FIG. 6B, two sides are connected to each other by a hinge 20 and to the base plate 28 by a linear bearing 112 connected to a pivot 114. This linkage is similar to the one in FIG. 6A but with a different relationship of pressure, volume and force produced by the rod 16 because the sides 18, rather than the base of the triangle, are of varying length.

Figure 7:
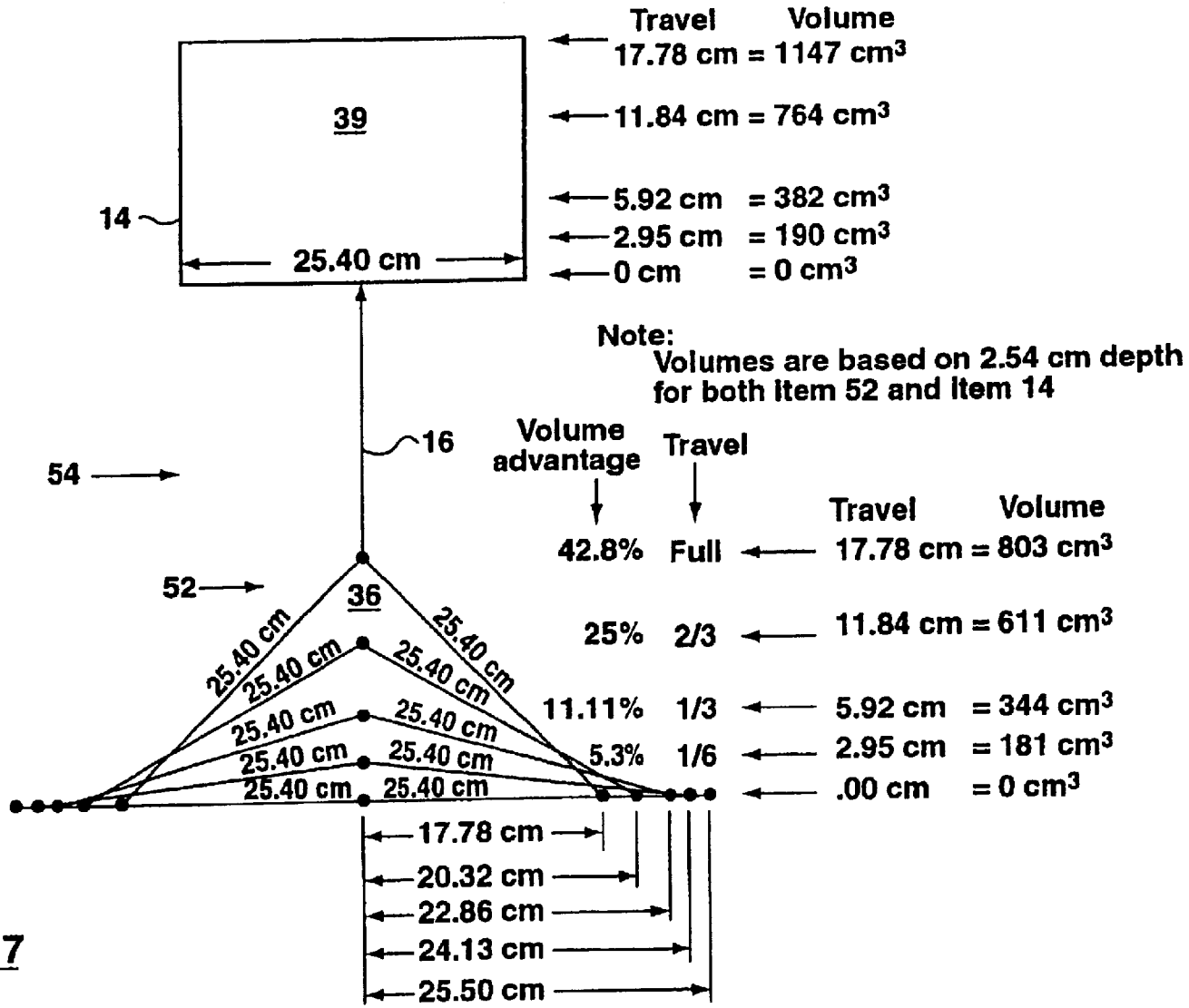
FIG. 7 shows the fluid input and output of a system having an isosceles triangle linkage and a cylindrical linkage.

Now referring to FIG. 7, a second fluid powered system 54 has an isosceles triangle linkage 52 coupled by a rod 16 to a cylindrical linkage 14. In the particular example shown, the sides 18 of the isosceles triangle linkage 52 are 10 inches long and 1 inch wide for an area of 10 square inches. The cross-sectional area of the cylindrical linkage 14 is also 10 square inches. The volume and displacement of the isosceles triangle linkage 52 and the cylindrical linkage 14 are shown at various points of displacement of the rod 16. At each of these points of displacement, the volume of driven fluid 39 displaced by the cylindrical linkage 14 is compared to the volume of fluid 36 entering the isosceles triangle linkage 52. As suggested by FIG. 4, the volume of driven fluid 39 leaving the second fluid powered system 54 increases faster than the volume of fluid 36 entering the second fluid powered system 54 as displacement increases.

Figure 8:
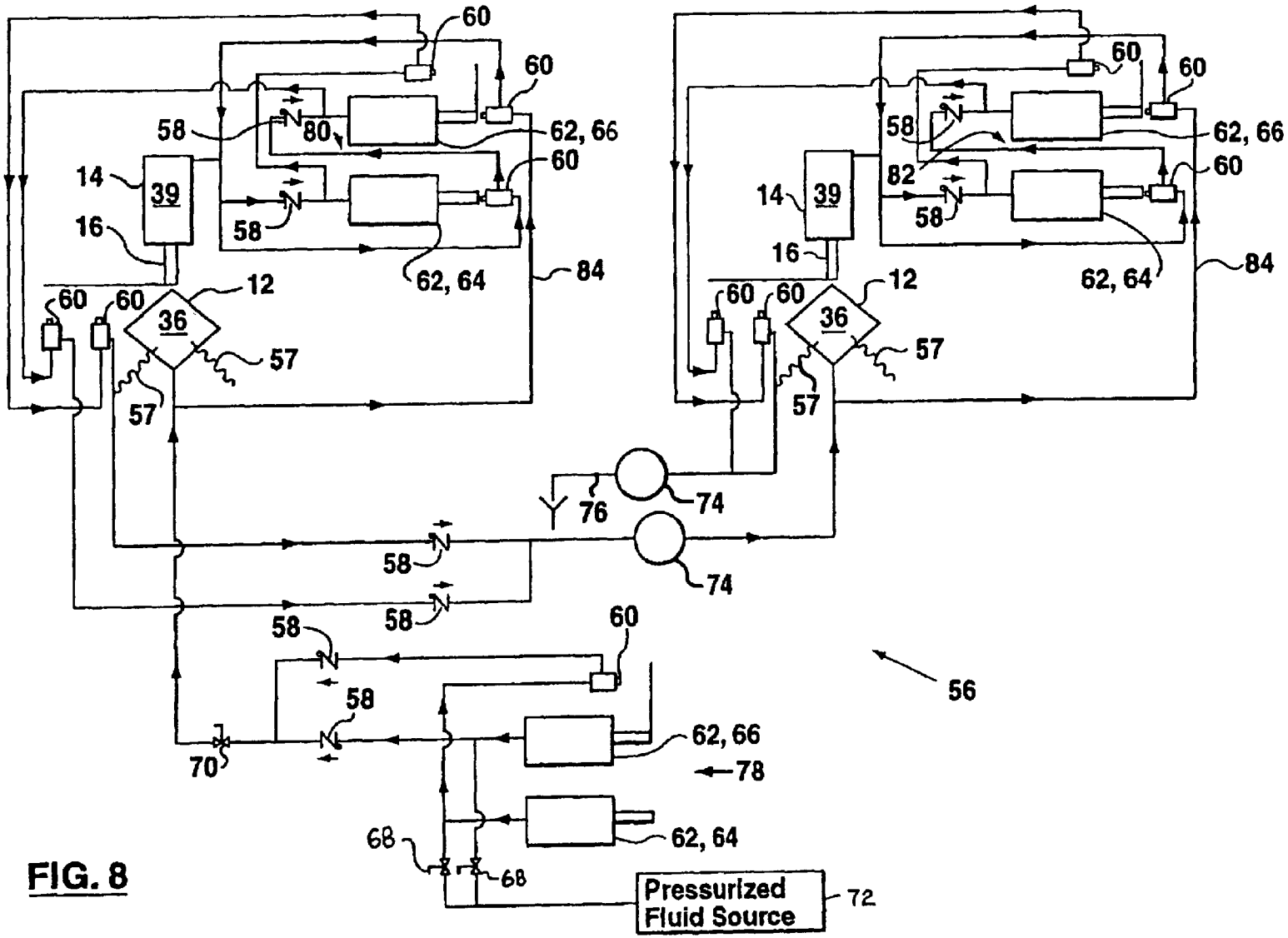
FIG. 8 is a schematic representation of the system of FIG. 1 used in an engine.

Now referring to FIG. 8, an engine 56 has diamond-shaped linkages 12 coupled to a cylindrical linkages 14 as in FIG. 1. In the example shown, the diamond-shaped linkages 12 have each a maximum volume of 100 cubic inches, a maximum displacement of 14 inches and springs 57 to return them to a nearly volume-less position. The cylindrical linkages 14 have an area of 10 square inches and thus move 140 cubic inches of liquid when operated by the diamond-shaped linkages 12. Other sizes of linkages may be used, but the volume of fluid moved by a cylindrical linkage 14 is greater than the maximum volume of its corresponding diamond-shaped linkage 12. The engine 56 also has check valves 58, normally closed valves 60 (which open when pressed), and hydraulic actuators 62. The hydraulic actuators 62 have internal springs which drive a piston as well as plungers attached to the piston for triggering the normally closed valves 60. The hydraulic actuators 62 are provided in pairs of a high range actuator 64 and a low range actuator 66, referring to the average force of the internal spring. Despite the difference in average force of their internal springs, however, the range of force of the high range actuators 64 and low range actuators 66 in a pair overlap. For example, high range actuators 64 having a spring varying from 5 to 10 pounds force over their stroking range and corresponding low range actuators 66 having a spring varying from 3 to 7 pounds force over their stroking range are appropriate for use with the linkages described above. Preferably, the high range actuators 64 displace a volume similar to the maximum volume of the next downstream diamond-shaped linkage 12 when moving through their stroking range. Further preferably, the low range actuators 66 displace a volume when moving through their stroking range similar to the difference between the volume of fluid moved by the next downstream cylindrical linkage 14 and the maximum volume of the next downstream diamond-shaped linkage 12. Also provided in the engine 56 are shut off valves 68, a start valve 70, an inlet 72 for pressurize fluid, turbines 74 to extract energy from the engine 56 and an outlet 76.

To operate the engine 56, a first pair 78 of actuators 62 are filled with pressurized fluid from the inlet 72 to their capacity and the system filled and vented. When, the start valve 70 is opened the first pair 78 of actuators 62 fill the next downstream diamond-shaped actuator 12 extending it to its maximum volume. Excess fluid flows through a by-pass line 84 as permitted by the relevant valves 60 as they open. As the diamond-shaped actuator 12 fills, it displaces driven fluid 39 in the corresponding cylindrical linkage 14 which fills a second pair 80 of actuators 62, filling the high range actuator 64 first. When the second pair 80 of actuators 62 are filled, valves 60 are opened providing a path for fluid in the by-pass line 84 and allowing the springs 57 to retract the diamond-shaped linkage 12. Before liquid is released from the second pair 80 of actuators 62, however, the cylindrical linkage 14 is filled with liquid 36 from the diamond-shaped linkage 12 and the excess liquid from the first pair 78 of actuators 62 as it similarly retracts. Once the cylindrical linkage 14 is refilled, the second pair 80 of actuators 62 are release to flow liquid through a turbine 74 to produce mechanical or electrical energy. Once the liquid flows through the turbine 74 it is released through an outlet 76, preferably with minimal pressure or velocity. Alternately, the liquid passing through the turbine 74 may be used to drive a second diamond-shaped actuator 12 as shown.

Figure 9:
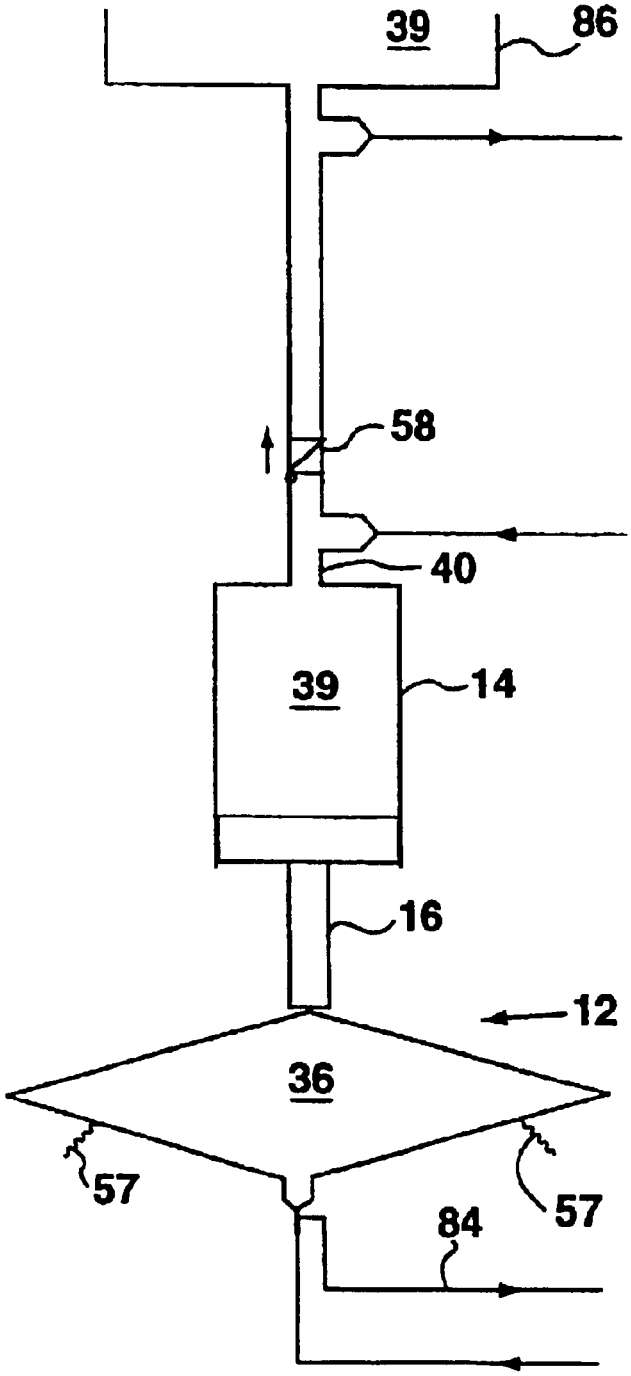
FIG. 9 is a schematic representation of the system of FIG. 1 with its output attached to a reservoir.

Now referring to FIG. 9, a diamond-shaped linkage 12 is coupled to a cylindrical linkage 14 as in FIGS. 1 and 8. The outlet of the cylindrical linkage 14, however, is connected to a storage tank 86. The storage tank 86 has a large horizontal cross-sectional area such that driven fluid 39 (which is a liquid in this example) in it has a near constant height despite movement of driven fluid 39 by the linkages. Such a storage tank 86 may be used in place of the actuators 62 downstream of a cylindrical linkage 14 in FIG. 8 to provide a more nearly constant pressure against the driven liquid 39. This alleviates a disadvantage of the actuators 62 that the force required to fill the actuators 62 increases with displacement. Contrarily, force in the rod 16 produced by the diamond-shaped actuator 12 decreases with displacement for a given pressure of liquid 36. Advantageously, a very tall cylindrical linkage 14 having a very small horizontal cross-sectional area used in the arrangement of FIG. 8 will require less force to move driven liquid 39 into the storage tank 86 as displacement increases.

EXAMPLE 1

Figure 10:
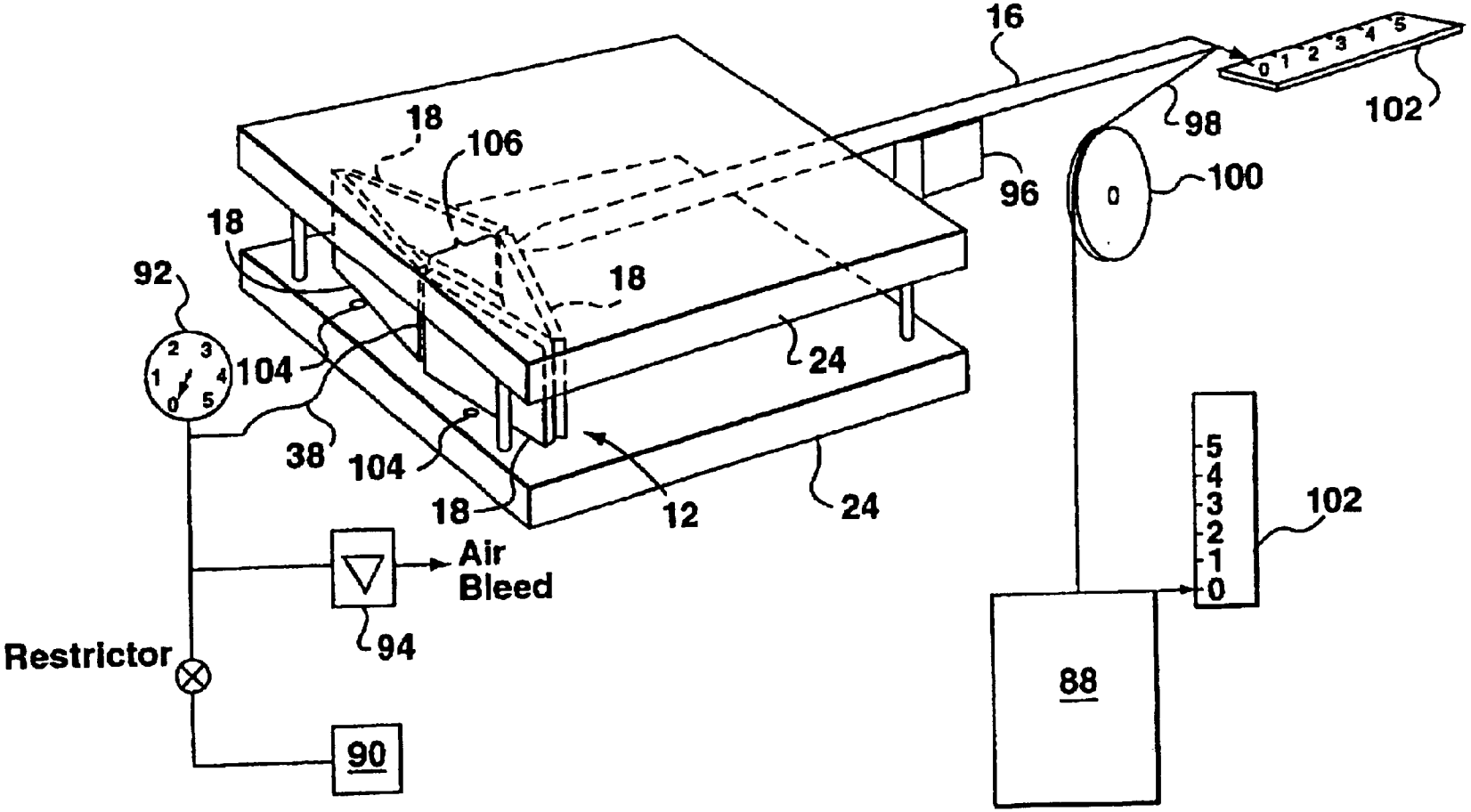
FIG. 10 is a schematic representation of the system of FIG. 1 used to position a load depending on pressure in the diamond-shaped linkage.

Now referring to FIG. 10, a diamond-shaped linkage 12 is used to position a hanging mass 88 of 50 pounds. In this case, however, the diamond-shaped linkage 12 is powered by compressed air. An air compressor 90 supplies pressurized air (through suitable reducing valves and restrictors if required) to the inlet pipe 38. Air pressure gauge 92 and pressure controller 94 (operable to bleed air from the inlet pipe 38) are used to control and measure pressure in the diamond-shaped linkage 12. The rod 16 is supported by linear motion bearing 96 and attached to a cable 98 wrapped around a pulley 100 such that the cable 98 is very nearly parallel to the rod 16 before contacting the pulley 100. The remainder of the cable 98 hangs downwards and is attached to the mass 88. Scales 102 measure the displacement of the rod 16 and mass 88. The sides 18 of the diamond-shaped linkage 12 are 9 inches long and 2.625 inches wide. A stop 104 prevents the total displacement 106 from being less than 1.938 inches. Air pressures of less than 5 psi were used. The gauge 92 is stated to be accurate to 0.05 psi and all measurements are relative to atmospheric pressure.

At a pressure of 1.2 psi, the rod 16 (and mass 88) started to move and advanced 1/32 inches. Pressure was increased to 2.5 psi and the rod 16 moved to a displacement of 1 15/16 inches. Pressure was lowered to 1.75 psi and the rod 16 moved to a displacement of 1 9/16 inches. Pressure was raised to 2.05 psi and the rod 16 moved to a displacement of 1 5/8 inches. The mass 88 was stable at all of these positions. In comparison, with a cylindrical linkage, holding the mass 88 in a stable position would only occur at one pressure setting and would require very accurate pressure maintenance. To move the mass 88 would require a precise momentary application of a different pressure and then a return to precisely the first pressure setting.

EXAMPLE 2

Figure 11:
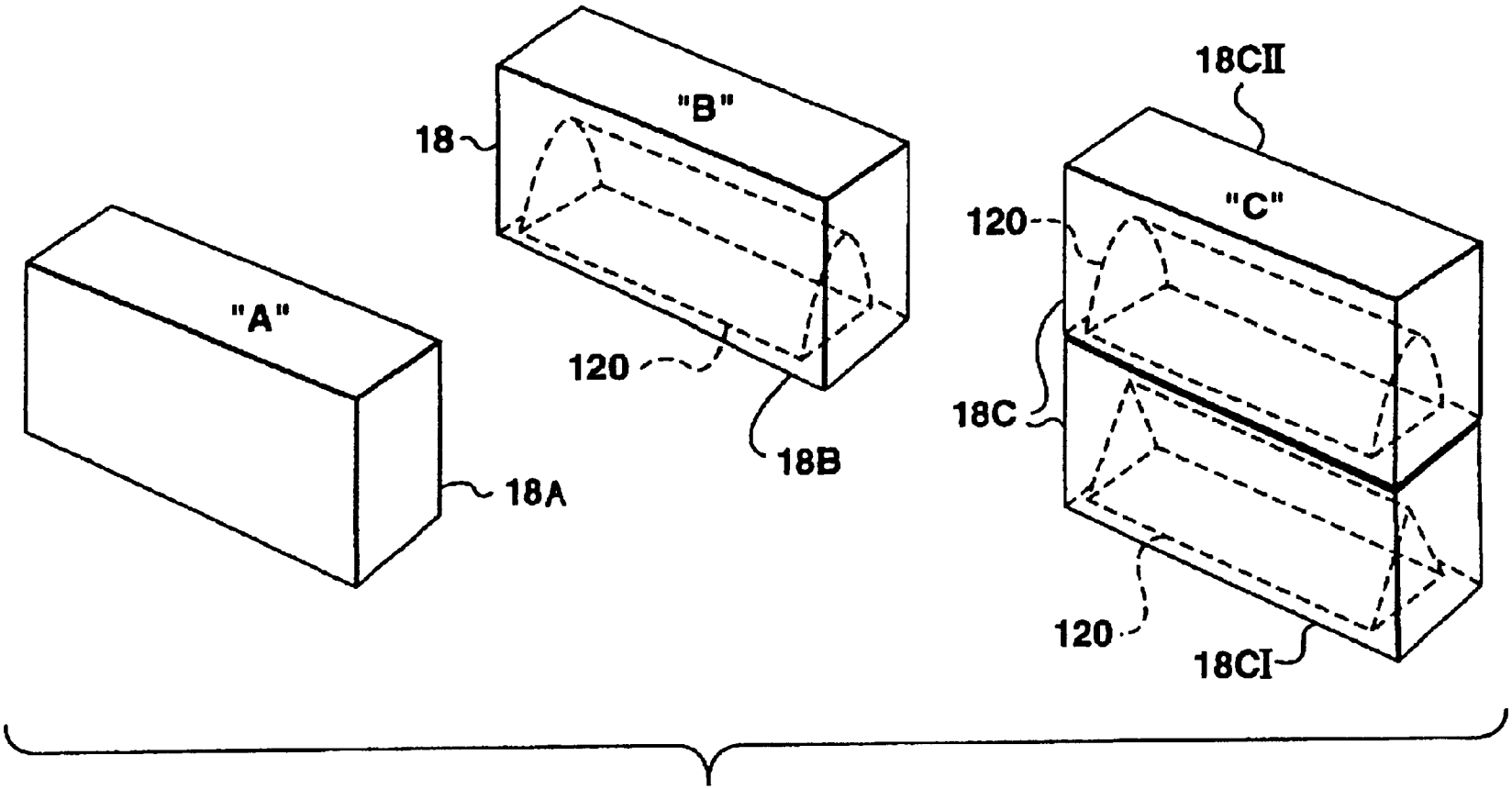
FIG. 11 are isometric representations of alternate sides of a diamond-shaped linkage.

A triangular linkage as shown in FIG. 6B powered by an air compressor was linked by a rod to a 4 inch low friction pneumatic actuator fed by a second compressor at 10.75 psig, or a total force of 135 pounds force. Different sides 18A, B and C as shown in FIG. 11 were used. Sides 18B and 18C have cavities or recesses 120 carved into the faces which contact the membrane. With side C, a hose from the air compressor was connected to the membrane in contact with side 18 CI and a second hose was connected to a second membrane in contact with the inside cavity of side 18 CII. The second membrane inside of side 18 CII was not in contact with the membrane which contacts side 18 CI. Both hoses had a common source of air pressure.

For each side 18, the linkage was first set up with no pressure in the membrane and the sides 18 parallel to each other. Pressure in the membrane was increased until the sides 18 moved against the pneumatic actuator. With side 18A, the actuator started to move with a pressure of 6 to 7 psig in the linkage. With side 18B, the actuator started to move with a pressure of 3.5 to 4 psig in the linkage. With side 18C, the actuator started to move with a pressure of 2 to 2.5 psig in the linkage.

EXAMPLE 3

A diamond-shaped linkage was mounted vertically so as to have a highest and a lowest abutment located at the obtuse angles of the diamond-shaped linkage and vertically above each other. Each side plate of the diamond-shaped linkage was 9.125 inches by 2.625 inches or about 23.95 square inches in area. The lowest abutment was secured to a fixed and stable platform. A rod extended upwards from the highest abutment. A scale was used to temporarily hold the rod and the diamond-shaped linkage at a slight displacement with the lowest abutment still secured to the platform. The scale registered a weight of 10 pounds and was then released. Weighed separately, the diamond-shaped linkage weighs 4.2 pounds and the rod weighed 4.9 pounds. An additional 50 pound mass was placed on top of the rod. Compressed air was fed into the diamond-shaped actuator through a pressure reducer and control valves. The gauge pressure of the air inside of the diamond shaped linkage was measured in inches of water. The following results were recorded.

| Approximate Gauge Pressure in Inches of Water | Inches of Displacement of the Rod |
|---|---|
| 56 | 1 |
| 59 | 2 |
| 61 | 2.4 |
| 62 | 2.5 |
| 63 | 2.7 |
| 66 | 2.9 |

More accurately, at a displacement of the rod of 2.5 inches, the gauge pressure was 61.8 inches of water and the internal volume of diamond shaped linkage was 59.3 cubic inches.

EXAMPLE 4

The apparatus of Example 3 was used as described in Example 3 except that different air pressures were applied. At 30 inches of water gauge pressure, the rod was displaced by 0.02 mm. Gauge pressures of 51, 54, 57 and 59 inches of water produced displacements of 0.4, 0.5, 0.6 and 0.8 mm respectively. The uppermost two sides of the diamond-shaped linkage were then removed and their inner faces routered to provide an inner surface defining recesses. The apparatus was then reassembled. After re-assembly, a gauge pressure of 24 inches of water produced a displacement of 0.02 mm. Gauge pressures of 51, 54, 57 and 59 inches of water produced displacements of 0.7, 0.8, 0.9 and 1.1 mm respectively, ie. greater displacements than those produced at the same pressures before the sides were recessed.

EXAMPLE 5

Figure 12:
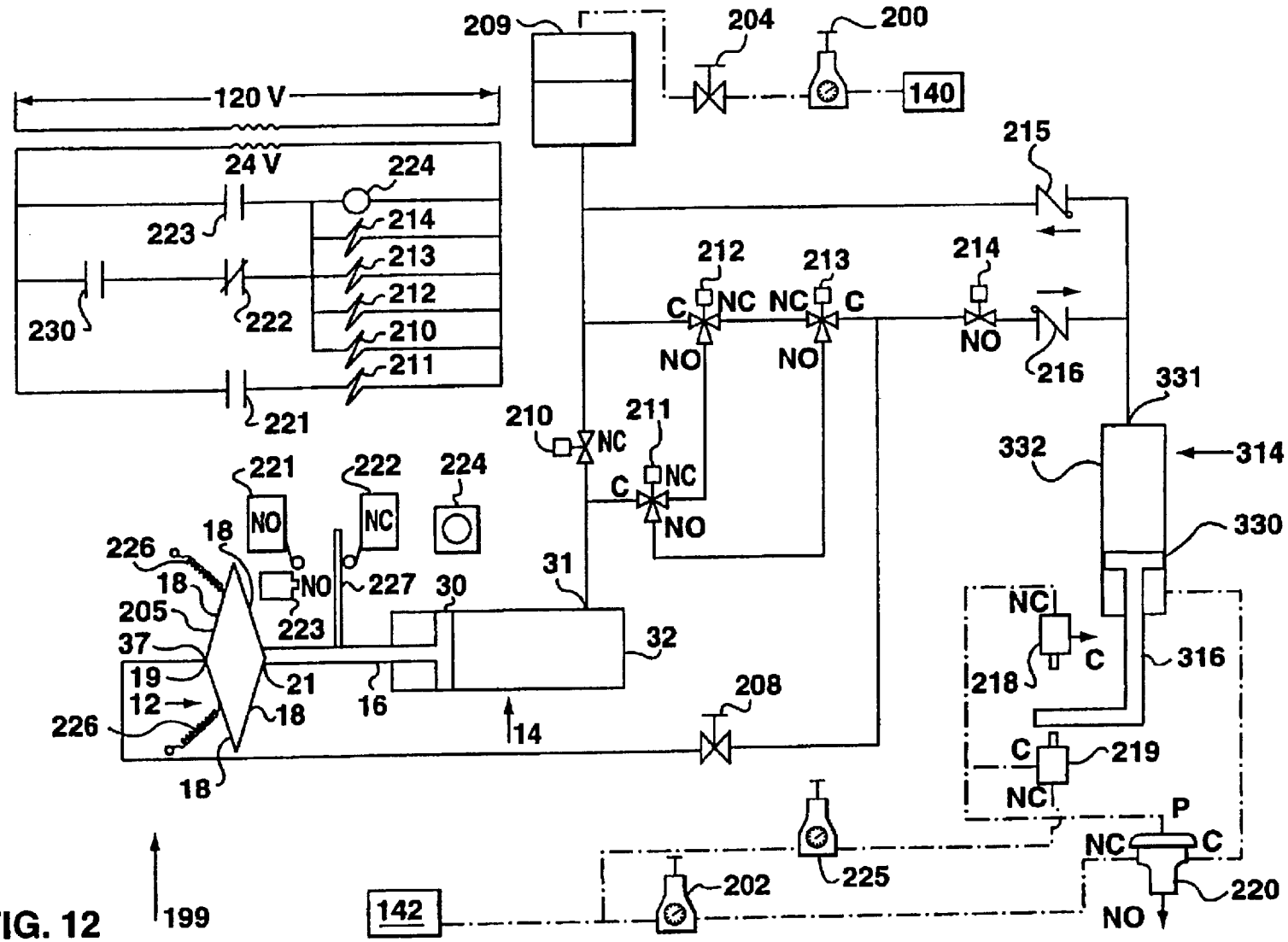
FIG. 12 is a schematic representation of the system of FIG. 1 used in another engine.

FIG. 12 shows a schematic representation of a hydraulic engine 199. A diamond shaped linkage 12 having sides of 7.5 inches by 1.6 inches and a cross-sectional area of 12.4 square inches is oriented with its upper abutment 21 spaced horizontally from its lower abutment 19. The upper abutment 21 is connected by a rod 16 to a cylindrical linkage 14 oriented horizontally and located at the same elevation as the diamond-shaped linkage 12. One or more spacing members (not illustrated) hold the lower abutment 19 of the diamond-shaped linkage 12 at a constant spacing from a cylinder 32 of the cylindrical linkage 14. The design of the hydraulic engine 199 is based on the area of the sides 18 of the diamond shaped linkage 12 being equal to or slightly less than the area of the piston 30 of the cylindrical linkage 14. In this example, this is achieved by the piston 30 having an area of 12.6 square inches or 1.5% more area than each of the sides 18.

A cylinder port 31 communicates with a normally closed (meaning that it remains closed until energized) first solenoid valve 210 and a first solenoid switching valve 211. The solenoid switching valves are shown in FIG. 12 as having a common ("C"), normally closed ("NC") and normally open ("NO") port. When not energized, these valves allow flow from the C to NO ports. When energized, these valves allow flow from the C to NC ports. Flow from the NO to NC ports is not permitted in either position.

The first solenoid valve 210 communicates with a cushion tank 209 pressurized by a compressed air supply 140 acting through a first pressure reducing valve 200 and a first hand valve 204. The first solenoid valve 210 also communicates with a first check valve 215 (which permits flow only in the direction of the arrow) and the common port of a second solenoid switching valve 212. The normally closed port of the first solenoid switching valve 211 communicates with the normally open port of the second solenoid switching valve 212. The normally closed port of the second solenoid switching valve 212 communicates with the normally closed port of a third solenoid switching valve 213. The normally open port of the first solenoid switching valve 211 communicates with the normally open port of a third solenoid switching valve 213. The common port of the third solenoid switching valve 213 communicates with a second hand valve 208 which communicates with the port 37 of the diamond-shaped linkage 12. The common port of the third solenoid switching valve 213 also communicates with a normally open second solenoid valve 214 which in turn connects with a second check valve 216. The first check valve 215 and second check valve 216 communicate with each other and with a second cylindrical port 331 of a second cylindrical linkage 314.

A second piston 330 of the second cylindrical linkage 314 is connected to a second rod 316. A second cylinder 332 of the second cylindrical linkage 314 sweeps through a volume of about 7.4 cubic inches. With the second cylinder 332 at its lowest volume, the second rod 316 contacts and opens a normally closed first push button valve 218. When open, the first push button valve 218 vents the common port of second push button valve 219 and the pilot of an air valve 220 to atmosphere. Without pressurized air on the pilot of the air valve 220, the common port of the air valve 220 is vented to atmosphere through the normally open port of the air valve 220. When pressurized air is supplied to the pilot of the air valve 220, air can flow from the common port to the normally closed port. With the second cylinder 332 at its highest volume, the second rod 316 contacts and opens a normally closed second push button valve 219. The common port of the second push button valve 219 communicates with the pilot of the air valve 220 while the normally closed port of the second push button valve 219 communicates with a second compressed air supply 142 through a second pressure reducing valve 225. The second compressed air supply 142 also communicates, through a third pressure regulator 202 with the normally closed port of the air valve 220. The common port of the air valve 220 communicates with a sealed volume of the second cylindrical linkage 314 on the dry side of the second cylindrical linkage 314 which is on the opposite side of second piston 330 from the second cylinder 332.

The rod 16 has a linkage 227 attached to it. When the diamond shaped linkage 12 is at its lowest volume of about 12.2 cubic inches, the linkage 227 contacts a normally open push button switch 223 and a normally open first end switch 221. When the diamond shaped linkage 12 is at its highest volume of about 15.7 cubic inches, the linkage 227 contacts a normally closed second end switch 222. A return spring 226 extends as the diamond-shaped linkage 12 increases in volume and retracts the diamond-shaped linkage 12 to its lowest volume when pressure to the port 37 of the diamond-shaped linkage 12 is released. A control relay 224 and control relay contacts 230 are provided. The various electrical components are wired to a circuit as shown in the upper left hand corner of FIG. 12.

After the components are assembled as described above, the hydraulic engine 199 is filled with hydraulic fluid and all air is vented. With the diamond-shaped linkage 12 at its minimum volume, the cylindrical linkage 14 contains about 50 cubic inches of fluid, the cushion tank contains about 2.5 liters of fluid and the second cylindrical linkage 314 is substantially empty. Second hand valve 208 is closed to prevent the hydraulic engine from starting until second hand valve 208 is opened. The hydraulic engine 199 may be started in any position, but will be described for example starting with the diamond-shaped linkage 12 at its lowest volume and the linkage 227 holding the push button switch 223 closed and the first end switch 221 closed.

The cushion tank 209 is pressurized via the first pressure reducing valve 200 by opening the first hand valve 204. After the cushion tank 209 is pressurized, the first hand valve 204 is closed. The first pressure reducing valve 200 (ie. the pressure in the cushion tank 209) controls the speed of operation and power output for the hydraulic engine 199. The higher the pressure setting of the first pressure reducing valve 200, the more power is generated. In this example, the hydraulic motor 199 was operated with the cushion tank 209 initially set at pressures ranging from 55 PSIG to 85 PSIG but a higher pressure is preferred, up to the mechanical limit of the components of the hydraulic motor. The third pressure reducing valve 202 is set for 20 PSIG above the setting of the first pressure reducing valve 200. The second pressure reducing valve 225 is set to satisfy the pilot requirements of air valve 120 without damaging the air valve 220. In this example, the second pressure reducing valve 225 is set to about 95% of the pressure in the cushion tank 209.

To operate the hydraulic motor 199, a 24 volt potential is applied to the electric circuit the second hand valve 208 is opened. The contacts of push buttton switch 223 are closed which energizes the relay 224 causing it to pull the control relay contacts 230 closed to keep valves 210, 212, 213 and 214 energized even after push button switch 223 opens its contacts. Hydraulic fluid in the cushion tank 209 communicates with and pressurizes the diamond-shaped linkage 12 and the cylinder 32 of the cylindrical linkage 14. A small amount of fluid may flow into the diamond-shaped linkage as its membrane compresses.

The cushion tank 209 causes hydraulic fluid at a constant pressure to be exerted at the port 37 and cylinder port 31. The total force generated at the upper abutment 21 of the diamond-shaped linkage 12 pushes rod 16 forward to force the piston 30 to displace fluid out of the cylindrical linkage 14. The linkage 227 advances which causes push button switch 223 to open its contacts and first end switch 221 to open its contacts. As mentioned above valves 210, 212, 213 and 214 remain energized. Fluid displaced travels from the cylindrical linkage 14 flows through first solenoid valve 210, through second solenoid switching valve 212, through third solenoid switching valve 213, through second hand valve 208 and into the diamond-shaped linkage 12. Any difference in volume of fluid displaced from the cylindrical linkage 14 and flowing into the diamond-shaped linkage is compensated for by the cushion tank 209. The diamond-shaped linkage 12 continues to fill with hydraulic fluid until the linkage 227 opens the contacts of second end switch 222.

Opening the contacts of second end switch 222 de-energizes valves 210, 212, 213 and 214 and control relay 224. Control relay contacts 230 open causing valves 210, 212, 213 and 214 to remain in their de-energized position. This isolates the cushion tank 209 from the diamond-shaped linkage 12, the cylindrical linkage 14 and the second cylindrical linkage 314. When the second solenoid valve 214 opens, it depressurizes the diamond-shaped linkage 12 and the cylindrical linkage 14 by allowing a very small volume of fluid to enter the second cylindrical linkage 314. The amount of fluid entering the second cylindrical linkage 314 depends in part on the elasticity of the membrane of the cylindrical linkage 314. In this example, the second cylindrical linkage 314 reached its maximum volume every two or three cycles. The return springs 226 can then pull the diamond-shaped linkage 12 and the cylindrical linkage 14 back toward their starting point.

As the diamond-shaped linkage 12 retracts (ie. decreases in volume), the cylindrical linkage 14 is refilled with fluid formerly held in the diamond-shaped linkage 12. A small difference in the volume leaving the diamond-shaped linkage 12 and entering the cylindrical linkage 14 is believed to be compensated for temporarily by the elasticity of the membrane of the diamond-shaped linkage 12. Then, as the linkage 227 nears its initial position, first end switch 221 closes its contacts to energize first solenoid switching valve 211 to allow the surplus volume stored in the cushion tank 209 to return to the cylindrical linkage 14. If more or earlier compensation is required, alternate means of connecting the cushion tank 209 to the cylindrical linkage 14 may be devised. When the cylindrical linkage 14 has been completely refilled, push button switch 223 (which the linkage 227 contacts slightly after contacting first end switch 221) closes its contacts again and the cycle repeats.

As mentioned above, the second cylindrical linkage takes in fluid with each cycle. After a number of cycles, the second rod 316 moves towards and contacts the second push button valve 219 which opens its pneumatic port to pass pressurized air to the pilot port of air valve 220. Air valve 220 passes compressed air into the dry side of the second cylindrical linkage 314 at a pressure about 20 PSIG higher than the pressure of cushion tank 109. Second check valve 216 prevents the fluid flow out of the second cylindrical linkage 314 from flowing backwards through second solenoid valve 214. First check valve 215 allows the fluid to flow out of the second cylindrical linkage 314 into the cushion tank 209 to be stored for future cycles. When the second cylindrical linkage 314 is empty, the second rod 316 pushes the plunger of first push button valve 218 to remove the pilot signal to air valve 220. This releases the pressure from the dry side of the second cylindrical linkage 314 to allow the second cylindrical linkage 314 to receive fluid to de-pressurize the diamond-shaped linkage 12 and the cylindrical linkage 14 in future cycles. Alternately, other hydraulic pumping mechanism could be used to return the fluid which enters the second cylindrical linkage in this example to the cushion tank 209.

The hydraulic motor 199 was operated for many cycles with the duration of each cycle being about 15 to 20 seconds.

It is to be understood that what has been described are preferred embodiments to the invention. The invention nonetheless is susceptible to certain changes and alternative embodiments fully comprehended by the spirit of the invention as described above, and the scope of the claims below. For example, although the terms "hydraulic" or "pneumatic" may be used in places and examples may describe operation with pressurized gases or liquids, the invention is adaptable to use with fluids generally although use with fluids is preferred.

I claim:

1. A fluid powered linkage, comprising:

(a) four sides of substantially equal width and length joined by hinges to form a diamond of variable cross sectional area;

(b) side plates to enclose a variable volume within the linkage, the variable volume bounded by inner surfaces of the sides and side plates;

(c) at least one port to allow fluid to enter into or leave from the enclosed variable volume in a controllable manner;

(d) one or more seals to prevent fluid from entering or leaving the enclosed variable volume other than through the one or more ports; and, (e) two abutments or connectors located substantially at the obtuse angles of the diamond on the sides or hinges, wherein the distance between the two abutments or connectors varies non-linearly with the variable cross-sectional area, and wherein at least one side rotates relative to another side as the cross-sectional area of the linkage varies.

2. The linkage of claim 1 wherein the obtuse angle ranges from nearly 180 degrees to about 135 degrees.

3. The linkage of claim 1 wherein the one or more seals comprise a membrane forming a plenum which varies in volume wherein the membrane is placed in the linkage to enclose the variable volume of the linkage and the at least one port connects the interior of the plenum with the outside of the linkage.

4. The linkage of claim 1 wherein one or more inner surfaces of one or more of the sides defines a recess within the one or more sides.

5. An apparatus for producing a fluid output with altered pressure, volume or flow characteristics compared to a fluid input, comprising:

(a) a fluid powered linkage, having:

(i) at least three sides of substantially equal width joined by first connectors to form a polygon of variable cross sectional area;

(ii) side plates to enclose a variable volume within the linkage, the variable volume bounded by inner surfaces of the sides and side plates;

(iii) at least one port to allow fluid to enter into or leave from the enclosed variable volume in a controllable manner;

(iv) one or more seals to prevent fluid from entering or leaving the enclosed variable volume other than through the one or more ports; and, (v) two abutments or second connectors on the sides or first connectors, wherein the distance between the two abutments or second connectors varies non-linearly with the variable cross-sectional area, and wherein at least one side rotates relative to another side as the cross-sectional area of the linkage varies;

(b) a piston movable in a cylinder to vary an enclosed volume in the cylinder;

(c) a cylinder port to allow fluid to exit or enter the enclosed volume of the cylinder;

(d) a rod between one of the two abutments or second connectors of the linkage and the piston; and, (e) one or more spacing members to hold the other of the two abutments or second connectors of the linkage at a constant spacing from the cylinder.

6. The apparatus of claim 5 wherein the area of the piston is between one and two times the area of a side.

7. The apparatus of claim 6 wherein the area of the piston is about equal to the area of a side of the diamond-shaped linkage.

8. The apparatus of claim 6 wherein the area of the piston is between 1.0 and 1.1 times the area of a side.

9. The apparatus of any of claim 1, 2, 3, 5, 6, or 4 wherein the fluid is a liquid.

10. The apparatus of any of claim 1, 2, 3, 5, 6, or 4 wherein the fluid is a gas.

11. The apparatus of claim 5 wherein inner surfaces of two of the sides adjacent the abutment or second connectors abutting or connected to the rod define recesses in the two sides.

12. A hydraulic motor, comprising:

(a) an apparatus as described in claim 5; and, (b) a reservoir containing a variable volume of a fluid and adapted to deliver that fluid at a static pressure or head measured at the elevation of the apparatus as described in claim 5 which exceeds one atmosphere;

wherein, (d) a network of switches and conduits operable to (i) place fluid from the reservoir in communication with the port and the cylinder port and (ii) to open the port and the cylinder port to atmoshperic pressure in repeated cyles.

13. The hydraulic motor of claim 12 further comprising a reservoir filling mechanism operable to receive a volume of fluid when the port and the cylinder port are opened to atmoshperic pressure in the repeated cyles and to transfer the received volume of fluid into the reservoir from time to time.

* * * * *